US006821045B2

(12) United States Patent
Whaley

(10) Patent No.: US 6,821,045 B2
(45) Date of Patent: Nov. 23, 2004

(54) RING METAL SHIELD FOR USE WITH CONCEALED FASTENER

(75) Inventor: Paul A. Whaley, Herculaneum, MO (US)

(73) Assignee: U.S. Ring Binder, LP, St. Louis, MO (US)

( * ) Notice: Subject to any disclaimer, the term of this patent is extended or adjusted under 35 U.S.C. 154(b) by 0 days.

(21) Appl. No.: 10/289,678

(22) Filed: Nov. 7, 2002

(65) Prior Publication Data

US 2004/0091304 A1 May 13, 2004

(51) Int. Cl.[7] ..... B42F 3/00

(52) U.S. Cl. ..... 402/62; 24/67 R; 24/67.11; 402/19; 402/70; 402/80 R; 402/502

(58) Field of Search ..... 402/19, 20, 26, 402/31, 41, 70, 73, 62, 80 R, 500, 502; 24/67 R, 67.3, 67.5, 67.11, 67 P

(56) References Cited

U.S. PATENT DOCUMENTS 5,810,500 A * 9/1998 Whaley ..... 402/31
5,879,097 A * 3/1999 Cheng ..... 402/26
6,019,538 A * 2/2000 Whaley ..... 402/75
6,394,686 B1 * 5/2002 Whaley et al. ..... 402/26

FOREIGN PATENT DOCUMENTS

GB 2304638 * 3/1997

* cited by examiner

*Primary Examiner*—Monica S. Carter
(74) *Attorney, Agent, or Firm*—Polster, Lieder, Woodruff & Lucchesi, LC

(57) ABSTRACT

An improved ring metal (12) includes a shield (12). An elongate plate (14) has a length generally corresponding to the length of a binder (B) in which the ring metal is installed. A hollow cylindrical post (16*a*, 16*b*) extends from the underside (18) of the plate, at each end of the plate. One end (US) of a concealed fastener (CF) used to secure the ring metal to a binder cover is fitted onto each post. The post subsequently engages the concealed fastener to secure the shield and fastener together. The posts aid alignment of the shield and fasteners during fabrication of the binder.

8 Claims, 4 Drawing Sheets

RING METAL SHIELD FOR USE WITH CONCEALED FASTENER

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to ring metals used in the fabrication of ring binders; and more particularly, to a ring metal for use with concealed fasteners by which the ring metal is attached to a spine portion of the ring binder.

Ring metal is a generic name for a paper holding device by which hole-punched sheets of paper are stored in a binder. The metal typically consists of two or more rings each of which is formed by two ring sections which are movable apart and together to open and close the binder, a mechanism operable by the binder user to open and close the rings, and a metal cover or shield which covers the mechanism. The shield comprises an elongated piece of metal whose length generally corresponds to the length of the binder and the size of the sheets of paper stored in the binder, and whose width generally corresponds to the width of a spine section of the binder (the portion of the binder between the end leaves of the binder).

Until recently, the shield was attached to the binder spine using rivets or the like. The shield had a hole formed in it at each end. Rivets were driven through the binder spine, from the outside of the binder and the underside of the shield, with the shank portion of the rivet extending above the top of the shield through the hole in the shield. The exposed end of the rivet was then upset over the top of the shield to capture the shield and attach it to the binder. A drawback to this technique was that the head of the rivet was visible on the outside of the binder and was considered unsightly by some.

To address this problem, manufacturers began using concealed fasteners to attach the ring metal to the binder. Examples of concealed fasteners are shown in U.S. Pat. Nos. 6,394,686 (the '686 patent) and 6,109,538 (the '538 patent) both of which are assigned to the same assignee as the present application. The concealed fasteners shown in these patents include prongs or spurs which are attached to a cardboard or similar type backing located on the inside surface of the spine. The prongs extend into the backing material, but do not go through the spine itself. Thus, there is no portion of the fastener visible from the outside of the binder. The other end of the concealed fastener abuts against the underside of the shield and is attached to the shield using an impact tool or the like which deforms the shield and abutting surface of the fastener so they attach to one another. An advantage of this is that the inner portion of the fastener is also not visible to one looking at the inside of the binder.

The present invention is directed to an improved ring metal for use with these type of concealed fasteners and is advantageous in the manufacture of ring binders using automated manufacturing processes.

BRIEF SUMMARY OF THE INVENTION

The present invention is directed to an improved ring metals for the fabrication of ring binders using concealed fasteners of the type disclosed in the '686 and '538 patents. The ring metal has a shield in which posts are formed at the respective ends of a plate and extend outwardly from the underside of the shield. Concealed fasteners used to attach the ring metal to the spine of the binder each have an opening in their surface which abuts against the underside of the shield. The size and shape of the opening corresponds to that of the post. To attach the shield and fastener together, the fastener is mounted on the post for the one surface of the fastener to abut against the underside of the shield. The outer or distal end of the post is then deformed about the fastener to attach the shield and fastener together. Use of the improved shield with the post extending from the underside of the plate facilitates manufacture of a ring binder using automated processes.

Other features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
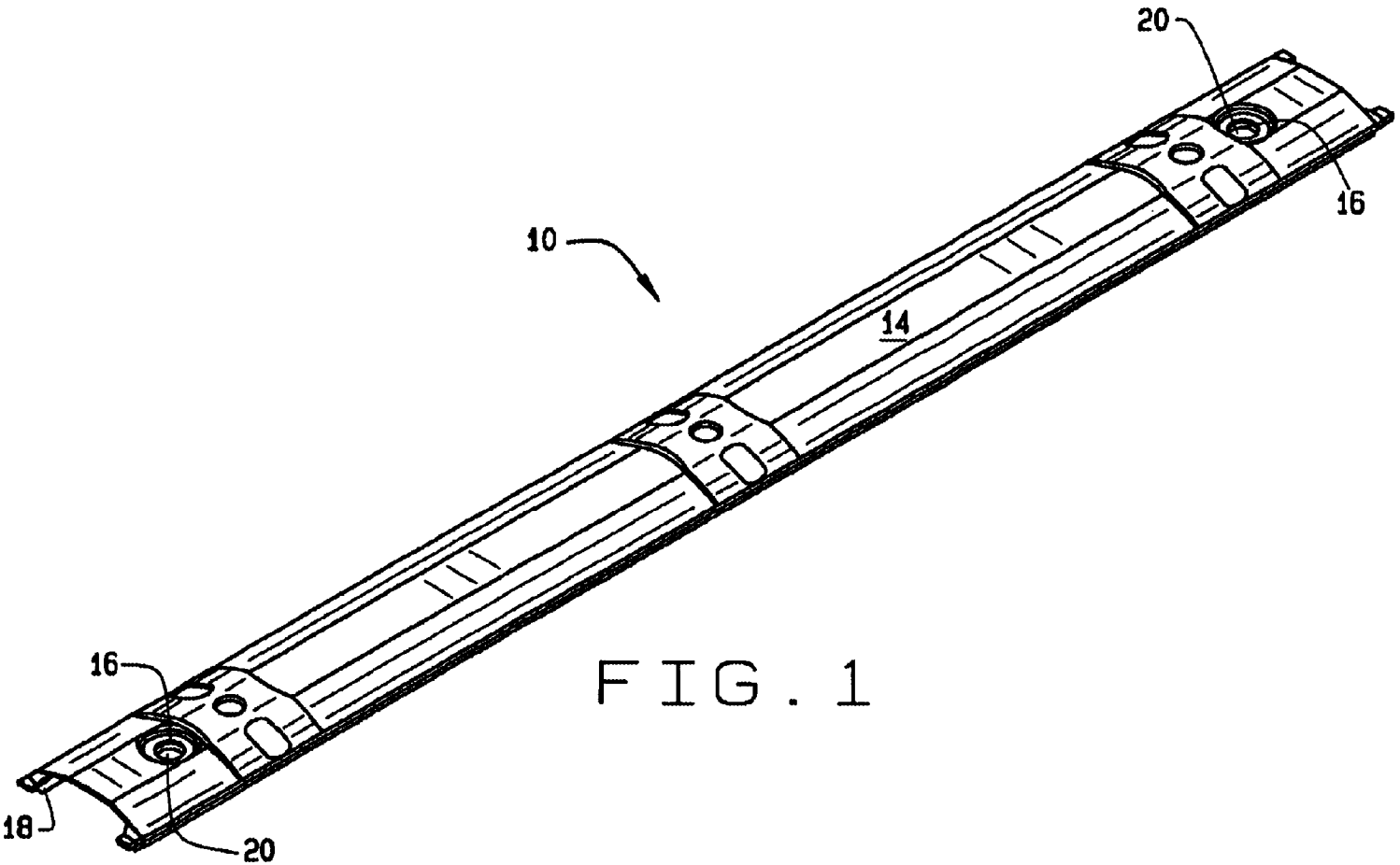
FIG. 1 is a perspective view of an improved ring metal of the present invention looking at the top of the shield.
Figure 4:
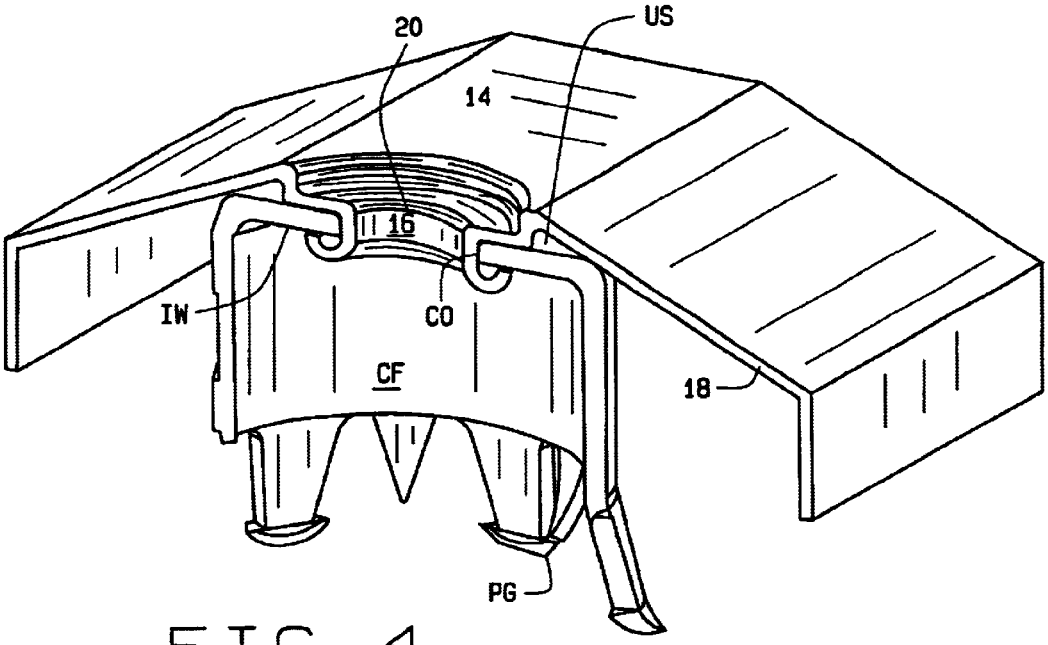
FIG. 4 is a sectional view of the ring metal showing the concealed fastener attached to the shield by deforming the outer end of the post against the shield; and, FIG. 5 is a perspective of the ring metal with concealed fasteners attached to the ends of the shield.
Figure 5:
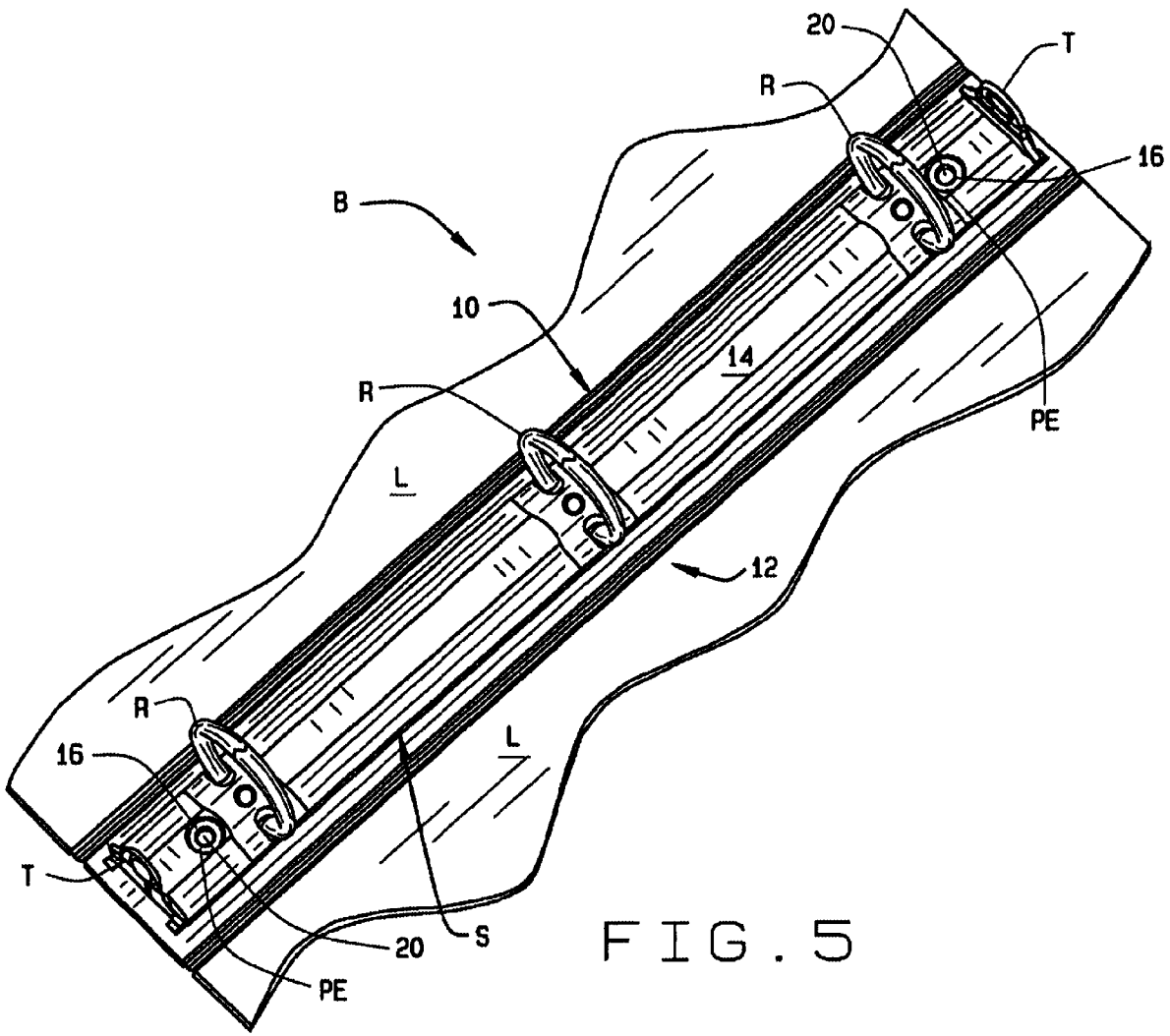

Referring to the drawings, an improved ring metal shield generally indicated 10 in FIG. 1 is for use in fabricating a ring binder B. As shown in FIG. 5, binder B has a pair of end leaves L connected together by a spine section S. A ring metal 12, which includes shield 10, attaches to the spine portion of the binder. Shield 10 comprises an elongate plate indicated generally 14. The length of plate 14, as shown in FIG. 5, generally corresponds to the length of binder B. The width of the plate generally corresponds to the width of the binder spine. Plate 14 has a flat center section with the sides of the plate angling downwardly as shown in FIGS. 1 and 4. It will be understood by those skilled in the art that the outer surface of the shield can be formed in a variety of ways to provide a decorative appearance. Accordingly, the outer surface of shield 10 shown in the drawings is illustrative only. In addition to shield 10, ring metal 12 typically includes binder rings R, three of which are shown in FIG. 5, and a trigger mechanism T located at each end of the shield, and extending beneath the shield, for opening and closing the rings.

Attachment of shield 14 to binder spine S is accomplished using concealed fasteners CF such as described in the previously referenced U.S. Pat. Nos. 6,394,686 and 6,109,538. The concealed fasteners form no part of this invention and are not described in detail. It will be noted that the fasteners CF shown in FIGS. 3 and 4 of the present application have a central opening CO in one end of the fastener indicated in the drawings as their upper surface US. This feature is shown, for example, in the '538 patent.

Figure 2:
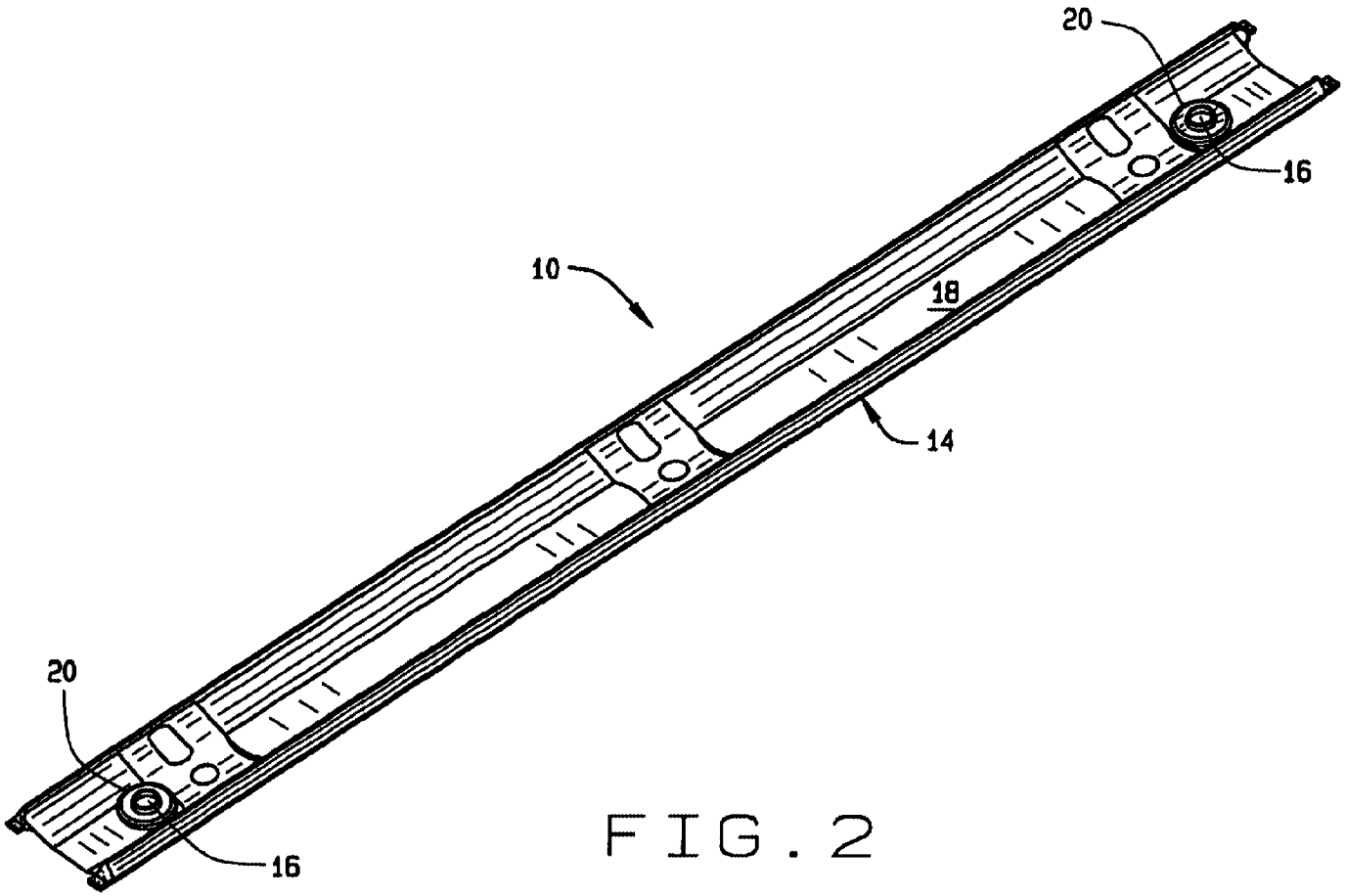
FIG. 2 is a similar perspective view looking at the underside of the shield.

Referring to FIG. 2, a pair of hollow, cylindrical posts 16 are formed respectively extend from an underside 18 of plate 14 adjacent each end of the plate. The posts are formed by a progressive die operation during manufacture of shield 10. When the posts are formed, respective openings 20 are also formed in the shield. It will be understood by those skilled in the art, that the posts can be separately formed and attached as, for example, by welding or gluing them to the underside of plate 14. However, by forming plate 14 and posts 16 as a one-piece, integral shield 10, the cost of making the shield is lower, and the shield is stronger.

Figure 3:
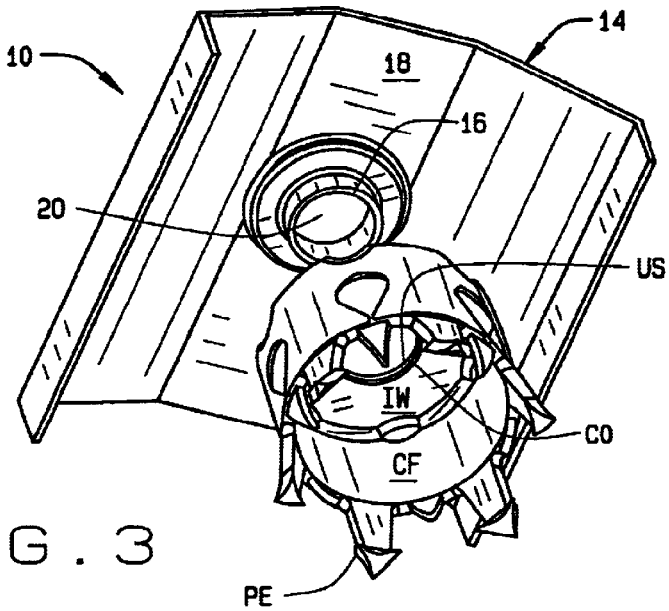
FIG. 3 illustrates a view of a section of the underside of the shield with a concealed fastener being positioned adjacent a post formed on the underside of the shield.

One end (end US) of each concealed fastener CF is used to attach the fasteners to the shield. The other, prong end PE of the concealed fastener is used to attach the shield 10/fastener CF sub-assembly to spine S of the binder, so to secure ring metal 12 to the binder. As shown in FIGS. 3 and 4, the concealed fastener is mounted on one of the posts 16 of shield 10. The upper end US of the fastener abuts against underside 18 of the shield when the fastener is in place. An advantage of using shield 10 with the concealed fasteners is in automated manufacturing processes for making or fabricating ring binders. In particular, the posts 16 act as guides for aligning the shield and fasteners so the concealed fasteners are easily positioned against the underside of the shield prior to securing the fasteners and shield together. The size and shape of the posts and the opening CO in the upper surface of the fastener conform to each other so the fasteners are readily mounted on the posts.

Once the concealed fastener is positioned as shown in FIG. 4, the fastener and shield can be attached together in a number of ways. As taught by the '538 patent (see FIG. 10 of the '538 patent), a punch tool can be driven against the top of shield 10 to deform the area about the location of the holes 20. The portion of the concealed fastener about its opening CO is also deformed by this punching operation. An area of upper surface US about the opening is also deformed and envelops the deformed portion of the shield and attaches the fastener and shield together.

In accordance with the present invention, however, the length of each post 16 is greater than the thickness of upper surface US of the fastener which abuts against underside 18 of plate 14. The portion of the post extending beyond an inner wall IW of the upper surface of the concealed fastener is now upset or deformed, as shown in FIG. 4, to bear against the inner wall. This causes the fastener to be pressed against the underside of the shield; again, attaching the shield and fastener together. Once both fasteners are attached to the shield, the prong end PE of the fastener is driven into the spine of the binder to complete attachment of the ring metal to the binder.

In view of the above, it will be seen that the several objects and advantages of the present invention have been achieved and other advantageous results have been obtained. In particular, the improved shield provides a low cost ring metal assembly which reduces manufacturing time and cost by facilitating alignment of a ring metal with the concealed fasteners used to attach it to the binder in automated processes.

What is claimed is:

1. An improved ring metal shield for use in fabricating a ring binder comprising:

an elongate plate a length of which generally corresponds to the length of a binder in which the ring metal is installed; and, a post extending from an underside of the plate, adjacent each end of the plate, each post being integrally formed with the shield for the posts and shield to be of a one-piece construction, one end of a concealed fastener used to secure the ring metal to a binder cover being fitted onto each post for the post to subsequently directly engage the concealed fastener and secure the shield and fastener together.

2. The improved shield of claim 1 wherein each concealed fastener has a surface which abuts against the underside of the shield, the surface having an opening therein, and the post being shaped to fit through the opening, the post facilitating alignment of the shield and concealed fastener in making the ring binder.

3. The improved shield of claim 2 in which the length of the post is greater than a thickness of the abutting surface of the concealed fastener.

4. The improved shield of claim 2 in which a portion of the post extends beyond an inner wall of the abutting surface of the concealed fastener, said portion being deformable to bear against the inner wall and press the concealed fastener against the underside of the shield to attach the shield and concealed fastener together.

5. An improved ring metal shield for use in fabricating a ring binder comprising an elongate plate attachable to a spine portion of the binder and a pair of posts extending from an underside of the plate adjacent each end of the plate, each post being integrally formed with the shield for the posts and shield to be of a one-piece construction, one end of a concealed fastener used to secure the shield to the binder being mounted on each post for engagement with the shield to attach the shield and concealed fastener together, each concealed fastener having a surface abutting against the underside of the shield, this surface having an opening therein by which the concealed fastener is directly mounted on the post, the post facilitating alignment of the shield and concealed fastener during fabrication of the ring binder.

6. The improved shield of claim 5 wherein the length of each post is greater than a thickness of the abutting surface of the concealed fastener for an outer end of the post to extend beyond an inner wall of the abutting surface of the concealed fastener, the outer end of the post being deformable against the inner wall of the abutting surface to press the concealed fastener against the underside of the shield and attach the shield and concealed fastener together.

7. The improved shield of claim 5 in which the posts are formed in the plate with an opening being formed in the plate when the posts are formed.

8. The improved shield of claim 7 in which the posts are hollow, cylindrical posts.

* * * * *